US007316317B2

(12) United States Patent
Harper

(10) Patent No.: US 7,316,317 B2
(45) Date of Patent: Jan. 8, 2008

(54) PACKAGING

(75) Inventor: Lewis James Harper, Bristol (GB)

(73) Assignee: Amcor Flexibles Winterbourne Ltd, London (GB)

( * ) Notice: Subject to any disclaimer, the term of this patent is extended or adjusted under 35 U.S.C. 154(b) by 333 days.

(21) Appl. No.: 10/544,205

(22) PCT Filed: Sep. 1, 2004

(86) PCT No.: PCT/GB2004/003717

§ 371 (c)(1),
(2), (4) Date: Aug. 2, 2005

(87) PCT Pub. No.: WO2005/023671

PCT Pub. Date: Mar. 17, 2005

(65) Prior Publication Data

US 2006/0138016 A1 Jun. 29, 2006

(30) Foreign Application Priority Data

Sep. 10, 2003 (GB) ..... 0321148.9

(51) Int. Cl.
*B65D 83/04* (2006.01)

(52) U.S. Cl. ..... 206/532; 206/531

(58) Field of Classification Search ..... 206/467, 206/469, 531, 532, 534.1, 538, 539, 484, 206/484.2

See application file for complete search history.

(56) References Cited

U.S. PATENT DOCUMENTS

| | | | | |
|---|---|---|---|---|
| 4,231,477 | A | 11/1980 | DeFelice | |
| 4,398,635 | A * | 8/1983 | Hirt | 206/532 |
| 5,944,191 | A * | 8/1999 | Ray et al. | 206/532 |
| 6,516,949 | B2 * | 2/2003 | Fuller et al. | 206/530 |
| 6,974,032 | B2 * | 12/2005 | Intini | 206/532 |
| 2003/0111379 | A1 * | 6/2003 | Itini | 206/531 |

FOREIGN PATENT DOCUMENTS

| | | |
|---|---|---|
| DE | 25 52 812 A | 2/1977 |
| EP | 0 045 449 A | 10/1982 |

* cited by examiner

*Primary Examiner*—David T. Fidei
(74) *Attorney, Agent, or Firm*—Bacon & Thomas PLLC

(57) ABSTRACT

Packages having a base web (2) consisting of a polymeric film or sheet having at least one recess (3) with a packaged item therein, and a sealing web (4) sealed to the base web (2) and covering the recess (3), the sealing web (4) having a strength which substantially prevents the packaged item from being pushed through it on applying force to the recess (3) in the base web (2). A portion of the package where the base web (2) is sealed to the sealing web (4) has two substantially parallel lines of weakness (11, 12) positioned so that said portion can be folded towards a portion of the sealing web (4) and a corner of the package can be used to puncture the sealing web (4) so that the packaged item can then be pushed through the sealing web (4).

7 Claims, 3 Drawing Sheets

PACKAGING

This invention concerns packaging and more particularly tamper resistant packaging.

Tamper resistant packaging is becoming ever more in demand in order to reduce the risk of unauthorised access to packaged products, either to reduce the risk of tampering with the product itself or indeed its removal. The latter is of particular concern with packaged pharmaceutical products and the possibility of children eating them.

Various proposals have been made hitherto for reducing the risk of children gaining access to pharmaceutical products, for example using containers which require a special technique to open them, e.g. using a clutch operated screw cap. However, whilst such containers are generally effective in making it difficult for children to gain access to their contents, they are also difficult to open by the people for whom the pharmaceutical products have been prescribed.

Instead of using containers with screw caps, pharmaceuticals are increasingly packaged in pop-through packages where each dosage unit is located in a recess in a flexible plastics base web, the recesses in the base web being sealed by a membrane, usually aluminum foil, through which the dosage unit can be pressed when required by pressing on the recesses. These packages have a number of advantages, such as the ease of determining correct filling of all of the recesses and counting the number of dosage units which have been taken. However, the ease of pressing the dosage units through the sealing membrane makes them poor at resisting unauthorised access.

Such packages can be provided with improved tamper resistance, for example by making the sealing membrane tougher. However, toughening the membrane also increases the force required to push the packaged product through the membrane to the point where this is impossible.

The present invention seeks to overcome or at least ameliorate the disadvantages of such packaging.

According to the present invention there is provided a package comprising a base web comprising a polymeric film or sheet having at least one recess therein and with a packaged item therein, and a sealing web sealed to the base web and covering the recess, the sealing web having a strength which substantially prevents the packaged item from being pushed therethrough on applying force to the recess in the base web, a portion of the package where the base web is sealed to the sealing web having two substantially parallel lines of weakness positioned so that said portion can be folded towards a portion of the sealing web and a corner of the package can be used to puncture the sealing web so that the packaged item can then be pushed through the sealing web.

As will be appreciated, packages in accordance with the present invention can be made from a variety of materials.

Subject to physical considerations which will be discussed subsequently, the base web can be made from any polymeric material used for blister packaging. Preferred materials for the base web are thermoformable polymer films or sheets, for example films or sheets of polyvinyl chloride.

The thickness of the base web can in general be selected according to criteria used hitherto for base webs for blister packaging, for example from 190 to 300 μm, subject to the combined stiffness of the base web and adhered sealing web, and its ability to puncture the sealing web as will subsequently be described in more detail.

The sealing web should be sufficiently strong that it effectively prevents packaged articles from being pushed therethrough without an initiating cut therein, but allow them to be pushed therethrough once the integrity of the sealing web over a particular recess in the base web has been compromised.

Sealing webs of packages in accordance with the present invention preferably have low permeability to oxygen and moisture. In hitherto proposed blister packages this has generally been provided by the use of a metal foil which is thin enough to allow packaged articles to be pushed therethrough. However, the present invention uses a sealing web which is stronger than hitherto proposed sealing webs, and so resists packaged articles being pushed through the sealing web.

Preferred sealing webs for packages in accordance with the present invention consist of a laminate of a metal foil, preferably aluminum foil, adhered to a strengthening polymeric layer which imparts the required additional strength to the sealing web. Preferred polymeric layers for the purpose include those made from polyesters, e.g. polyethylene terephthalate, polyamides and polyolefins, e.g. polypropylene.

Where necessary, the metal foil can be adhered to the strengthening polymeric layer using a water or organic solvent based laminating adhesives containing polyurethane or polyethyleneimine, or using an extrudable tie or adhesive layer, for example a maleic anhydride modified polyethylene.

The sealing web of packages of the present invention will in general be sealed to the base web so that the strengthening polymeric layer of the former is external relative to the metal foil. In general, this sealing will require the presence of a tie or adhesive layer which will usually be applied to the metal foil prior to sealing of the sealing web to the base web. However, the base web could be provided with an outer layer of a tie or adhesive layer. Materials for effecting sealing of the metal foil to the base web include ethylene/vinyl acetate and ethylene/acrylic acid based adhesive dispersions.

As indicated above, the sealing web should have a strength which substantially prevents packaged articles from being pushed therethrough but should also be capable of being punctured by a combination of the base web sealed to the sealing web. The thicknesses of the various layers of the sealing web can therefore be varied in order to achieve this effect. However, the metal foil will usually be of a thickness substantially that used hitherto for pop-through packages, for example from 20 to 30 μm. The strengthening polymeric layer is preferably from 10 to 50 μm, and more preferably from 10 to 30 μm.

The tie or adhesive layer used to adhere the metal foil to the strengthening polymeric layer will usually be less than 5 μm thick.

The adhesive layer used to adhere the sealing web to the base web will usually be less than 10 μm thick, and preferably be about 5 μm thick.

Packages in accordance with the present invention can be produced by known methods. Thus the base web can be produced by thermoforming a suitable polymeric film or sheet to produce recesses for the articles to be packaged. The sealing web can also be produced using known methods according to the particular structure of the web. Sealing webs consisting of a metal foil adhered to a polymeric strengthening layer can be formed, for example, by adhesion laminating a pre-formed strengthening layer to a metal foil using a tie or adhesive layer, or by pre-coating the metal foil with a tie or adhesive layer and using the tie or adhesive layer to adhere the metal foil to the strengthening layer.

The adhesive layer used to adhere the metal foil to the base web will in general be applied as a pre-coat to the metal foil before the sealing web is adhered to the base web.

In order to provide corners of regions of packages of the present invention where the base and sealing webs are sealed together with sufficient strength to puncture the sealing webs, these sealed regions themselves tend to be sufficiently stiff that they cannot be bent around to effect the puncturing. The present invention therefore provides at least two lines of weakness which allow a corner of the packages to be bent along these lines so that a corner of the packages can effect the necessary puncturing.

The position of the lines of weakness relative to an associated corner of the packages can generally be varied, provided the desired puncturing can be effected.

An embodiment of package in accordance with the present invention will now be described with reference to the accompanying drawings in which.

Figure 2:
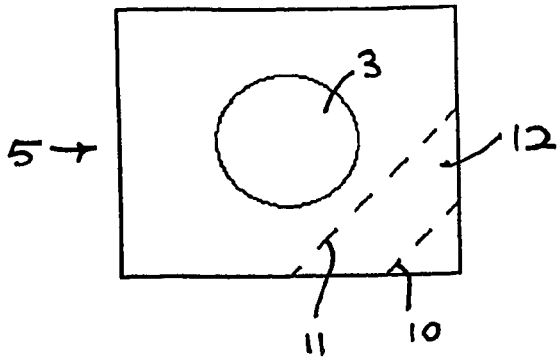
FIG. 2 is a plan view of a single sealed blister of the embodiment prior to opening.
Figure 3:
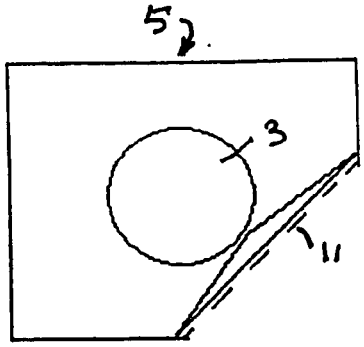
Figure 4:
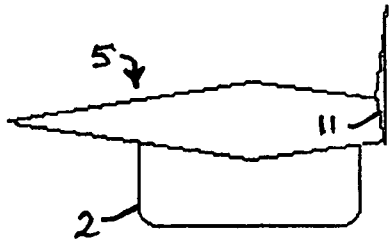
Figure 5:
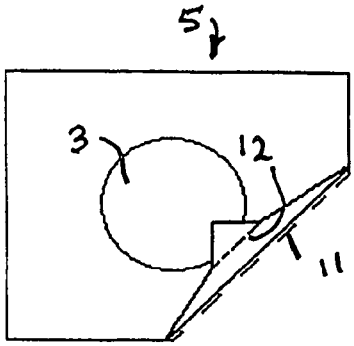
Figure 6:
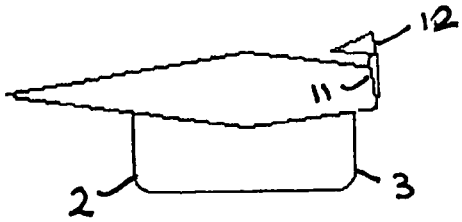
Figure 7:
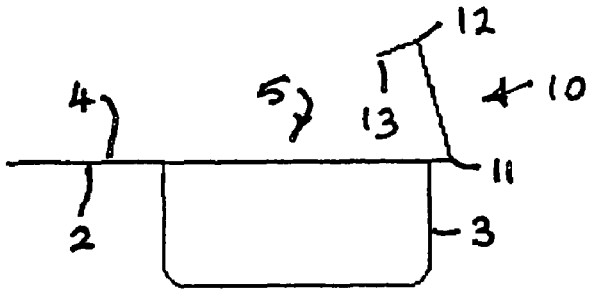
Figure 8:
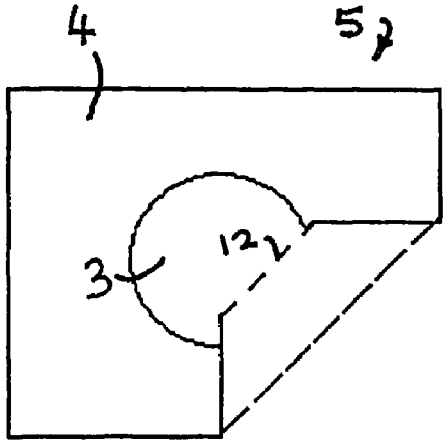

FIG. 3 corresponds to FIG. 2 during an initial phase of opening of the single blister;

FIG. 4 is a perspective view corresponding to FIG. 3;

FIG. 5 corresponds to FIG. 2 during a further stage of opening of the blister;

FIG. 6 is a perspective view corresponding to FIG. 5;

FIG. 7 is a side view corresponding to FIGS. 5 and 6;

FIG. 8 is a plan view of the blister during piercing of the blister; and

Figure 9:
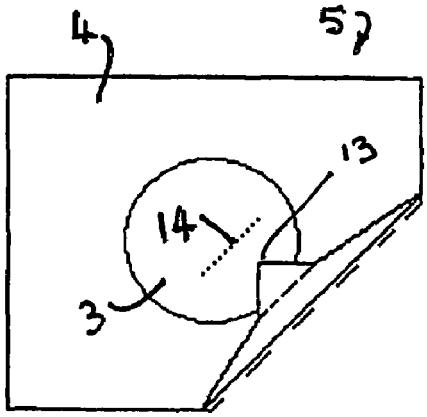

FIG. 9 is a plan view of the blister after piercing has taken place.

Figure 1:
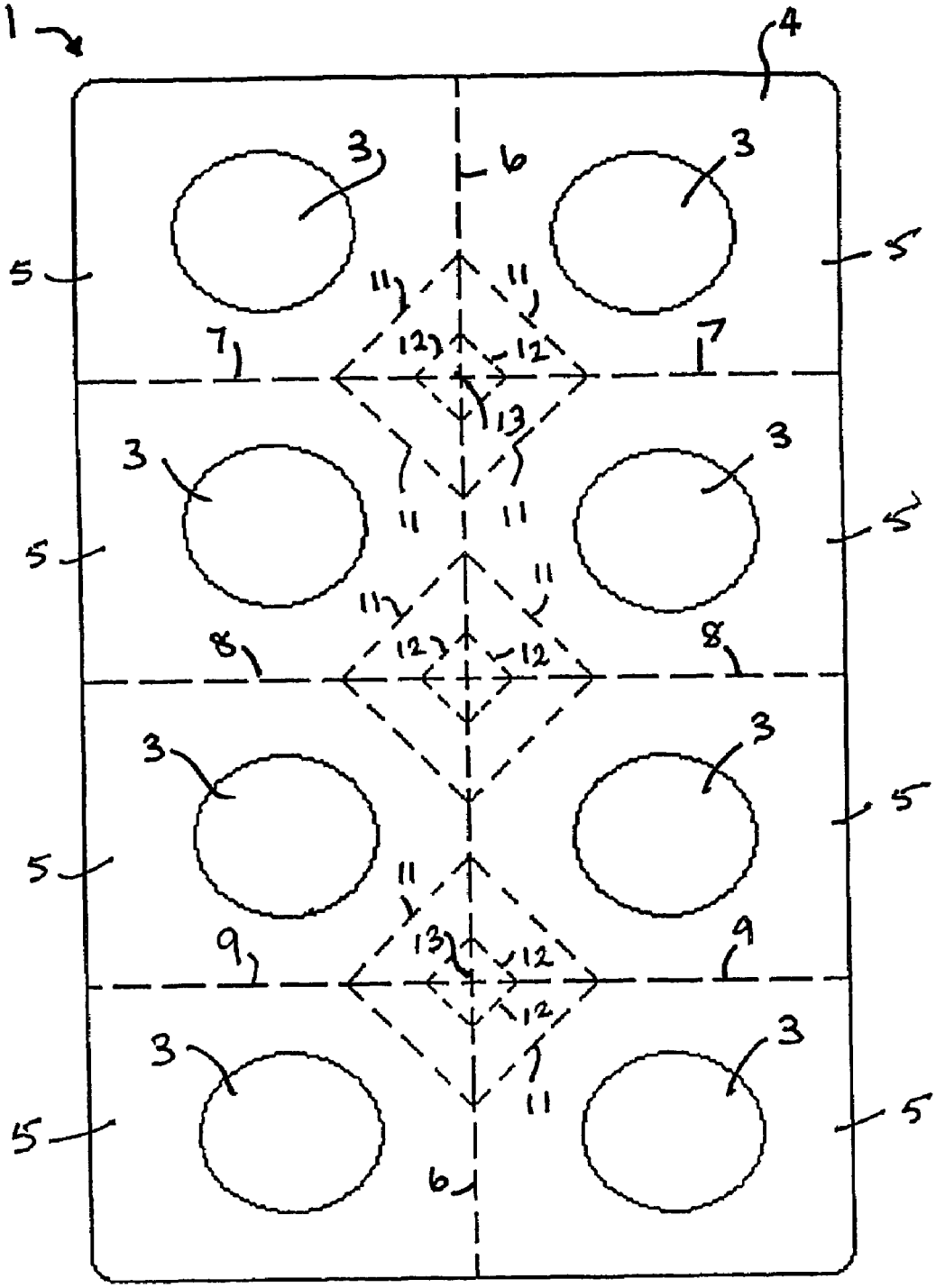
FIG. 1 is a plan view of the embodiment with a plurality of sealed blisters.

The package shown generally at 1 in FIG. 1 consists of a thermoformed base web 2, having eight recesses 3 therein, with a sealing web 4 heat sealed thereto. The size, shape and number of recesses 3 can be varied according to the number of articles to be packaged by the package.

The package 1 is divided into eight individual blister packs 5 which are connected to each other along tear lines 6, 7, 8 and 9 which allow individual blister packs 5 to be separated from the others, for example when packaged articles (not shown) within the recesses 3 are to be removed therefrom. FIGS. 2-9 show one such blister package 5 separated from the other seven shown in FIG. 1.

A corner region 10 of the blister package 5 shown in FIGS. 2-9 has two substantially parallel lines of weakness 11 and 12 formed therein substantially parallel to the circumference of the recess 3, for example by heating, which allow the region 10 to be folded as shown in FIGS. 3-9. The first fold is shown along the line 11, with the second fold being along the line 12.

As will be appreciated, the folds could be made in the reverse order.

As can be seen from FIGS. 5-7, this folding process produces a spike 13 for puncturing the sealing web 4, further folding along the line 11 resulting in the spike 13 effecting puncturing as shown in FIG. 8 to form a cut 14 in the sealing web 4 covering the recess 3.

The cut 14 weakens the sealing web 4 and enables the packaged article to be pushed therethrough.

The production of a package 1 will now be described by way of example only.

EXAMPLE

A sealing web for the package was produced by coating one side of a 23 μm thick aluminum foil with 1 μm of a tie layer and using the tie layer to adhere the foil to a 12 μm thick layer of cast polyethylene terephthalate. The free surface of the aluminum foil was then coated with 5 μm of the adhesive tie layer material. The puncture resistance of the uncoated aluminum foil was 8.729N (standard deviation 1.82), that of the cast polyethylene terephthalate was 2.79N and that of the laminate of the aluminum foil to the cast polyethylene terephthalate was 31.97N(standard deviation 3.47), the test being effected according to ASTM D3763 and a speed of 20 inches/minute (50.8 cm/min).

A base web was produced by thermoforming a 190 μm thick sheet of polyvinyl chloride to produce eight recesses into which articles to be packaged were inserted. The adhesive coated surface of the sealing web was then heat sealed to the base web using heat seal jaws at a temperature of 140° C. and a dwell time of 1 sec.

During the package manufacturing process, tear lines 6-9 were produced by perforation through the sealing web 4 and the base web 2, and the lines of weakness or fold lines 11 and 12 were produced by heating the two webs along these lines to thermoform the ridges into the baseweb.

The invention claimed is:

1. A package comprising a base web comprising a polymeric film or sheet having at least one recess therein and with a packaged item therein, and a sealing web sealed to the base web and covering the recess, the sealing web having a strength which substantially prevents the packaged item from being pushed therethrough on applying force to the recess in the base web, a portion of the package where the base web is sealed to the sealing web having two substantially parallel lines of weakness positioned so that said portion can be folded towards a portion of the sealing web and a corner of the package can be used to puncture the sealing web so that the packaged item can then be pushed through the sealing web.

2. A package according to claim 1, wherein the sealing web comprises a metal foil adhered to a polymeric web.

3. A package according to claim 2, wherein the metal foil comprises aluminum.

4. A package according to claim 2, wherein the polymeric web comprises polyethylene terephthalate.

5. A package according to claim 1, wherein the polymeric film or sheet comprises polyvinyl chloride.

6. A package according to claim 1, wherein the polymeric film or sheet has been thermoformed.

7. A package according to claim 1, wherein the polymeric film or sheet has been heat sealed to the sealing web.

* * * * *